US009074400B2

(12) United States Patent
Mirshekari et al.

(10) Patent No.: US 9,074,400 B2
(45) Date of Patent: Jul. 7, 2015

(54) OVEN DOOR OPENING AND CLOSING DEVICE

(75) Inventors: Behnam Mirshekari, Hannover (DE); Klaus Walzlein, Schwabach (DE); Simone Stephan, Ansbach (DE); Klaus Kern, Adelshofen (DE); Dietmar Hildner, Furth (DE); Gerhard Schaff, Cadolzburg (DE); Branko Ivanovic, Wurzburg (DE); Tobias Weber, Burk (DE)

(73) Assignee: ELECTROLUX HOME PRODUCTS CORPORATION N.V., Brussel (BE)

( * ) Notice: Subject to any disclaimer, the term of this patent is extended or adjusted under 35 U.S.C. 154(b) by 388 days.

(21) Appl. No.: 13/147,233

(22) PCT Filed: Jan. 20, 2010

(86) PCT No.: PCT/EP2010/000299

§ 371 (c)(1),
(2), (4) Date: Dec. 12, 2011

(87) PCT Pub. No.: WO2010/091770

PCT Pub. Date: Aug. 19, 2010

(65) Prior Publication Data

US 2012/0067333 A1 Mar. 22, 2012

(30) Foreign Application Priority Data

Feb. 13, 2009 (EP) ..... 09002011
Aug. 29, 2009 (EP) ..... 09011103

(51) Int. Cl.
*F24C 15/02* (2006.01)
*E05F 1/10* (2006.01)
(Continued)

(52) U.S. Cl.
CPC ..... *E05F 1/1041* (2013.01); *E05F 1/1261* (2013.01); *E05F 1/1276* (2013.01);
(Continued)

(58) Field of Classification Search
CPC ..... E05F 1/1041; E05F 1/1261; E05F 1/1276; E05Y 2900/308
USPC ..... 126/190–192, 194, 197, 287; 110/175 A; 188/266, 266.3, 72.7, 290, 188/293
See application file for complete search history.

(56) References Cited

U.S. PATENT DOCUMENTS 1,645,114 A * 10/1927 Packer ..... 126/190
2,969,560 A * 1/1961 Pierie et al. ..... 16/49
(Continued)

FOREIGN PATENT DOCUMENTS

DE 102005045365 3/2007
DE 102006040211 3/2008
(Continued)

OTHER PUBLICATIONS

International Search Report for PCT/EP2010/000299, dated Mar. 16, 2010, 3 pages.

*Primary Examiner* — Alissa Tompkins
*Assistant Examiner* — Steven Anderson, II
(74) *Attorney, Agent, or Firm* — Pearne & Gordon LLP

(57) ABSTRACT

An oven door opening and closing device includes at least one hinge connectable to an oven door and to an oven housing for realizing a predetermined pivoting opening and closing movement of the oven door relative to the oven housing between an open and a closed position. At least one closing force generating device generates a predetermined closing force, and a kinematic device is coupled to the hinge and to a moveable element in such a manner that the predetermined pivoting opening and closing movement of the hinge is converted into a predetermined reciprocating opening and closing movement of the moveable element. At least one damping system has a damper for generating a damping force which counteracts the closing movement of the movable element within a predetermined section, which corresponds to a predetermined angle section of the pivoting closing movement of the hinge shortly prior to the closed position.

7 Claims, 9 Drawing Sheets

(51) Int. Cl.
*E05F 1/12* (2006.01)
*E05F 3/14* (2006.01)
*E05F 5/02* (2006.01)

(52) U.S. Cl.
CPC ..... *E05F 1/1292* (2013.01); *E05F 3/14* (2013.01); *E05F 5/02* (2013.01); *E05Y 2201/21* (2013.01); *E05Y 2201/266* (2013.01); *E05Y 2201/722* (2013.01); *E05Y 2900/308* (2013.01)

(56) References Cited

U.S. PATENT DOCUMENTS

| | | | | |
|---|---|---|---|---|
| 3,749,080 | A * | 7/1973 | Kleinhenn | 126/191 |
| 3,893,550 | A * | 7/1975 | San Pablo De La Rosa | 188/322.19 |
| 4,109,455 | A * | 8/1978 | Zacharin | 368/327 |
| 5,225,644 | A * | 7/1993 | Jo | 219/722 |
| 6,397,836 | B1 * | 6/2002 | Pelletier et al. | 126/194 |
| 6,464,052 | B1 * | 10/2002 | Hsiao | 188/290 |
| 6,789,293 | B2 * | 9/2004 | Habegger et al. | 16/343 |
| 6,951,267 | B2 * | 10/2005 | Heo | 188/266.3 |
| 7,676,888 | B2 * | 3/2010 | Vanini | 16/286 |
| 8,357,886 | B2 * | 1/2013 | Yoshidome | 219/725 |
| 2002/0096405 | A1 | 7/2002 | Gasser | |
| 2003/0056328 | A1 | 3/2003 | Habegger et al. | |
| 2006/0131111 | A1 * | 6/2006 | Nakanishi et al. | 188/67 |
| 2007/0283532 | A1 * | 12/2007 | Vanini | 16/277 |
| 2009/0115115 | A1 * | 5/2009 | Zeilenga et al. | 267/69 |
| 2012/0067333 | A1 * | 3/2012 | Mirshekari et al. | 126/192 |

FOREIGN PATENT DOCUMENTS

| | | | |
|---|---|---|---|
| DE | 202007012603 | | 1/2009 |
| EP | 0565809 | | 10/1993 |
| EP | 1006251 | | 6/2000 |
| EP | 1847670 | | 10/2007 |
| EP | 2218859 | | 8/2010 |
| EP | 2218860 | | 8/2010 |
| GB | 2401161 | B * | 9/2006 |

* cited by examiner

OVEN DOOR OPENING AND CLOSING DEVICE

TECHNICAL FIELD

The present invention relates to an oven door opening and closing device and to an oven including such a device.

BACKGROUND TECHNOLOGY

Oven opening and closing devices often comprise one or more hinges, which are fixed to the door as well as to the housing of the oven, such that a user can open and close the oven door by means of a pivoting movement. Moreover, oven opening and closing devices usually contain at least one closing force generating means for generating a predetermined closing force. This closing force needs to be selected in such a manner, that a good sealing performance between the oven door and the housing of the oven is achieved. However, high closing forces lead to undesirable loud impact noises when closing the oven door. Therefore, it was proposed to provide buffers at the front frame of the oven housing in order to absorb at least part of the impact force. However, such buffers cannot completely remove the impact noises. Moreover, the return force provided by a buffer has adverse effects on the closing force and hence on the sealing function realized by the closing force generating means. Finally, the buffers are arranged at a visible location, which might violate the appearance of the oven.

Staring from this prior art technology, it is an object of the present invention to provide an oven opening and closing device, which has an alternative configuration in order to eliminate the foregoing drawbacks. Moreover, it is an object of the present invention to provide an oven comprising such an oven door opening and closing device.

DISCLOSURE OF THE INVENTION

The above-mentioned objects are solved by providing an oven door opening and closing device according to claim 1 and an oven according to claim 9. The dependent claims refer to individual embodiments of the present invention.

The oven door opening and closing device according to the present invention comprises one or more hinges, which are connectable to an oven door and to an oven housing. Such hinges realize a predetermined pivoting opening and closing movement of the oven door relative to the oven housing between an open and a closed position, whereby the angle between the open and the closed position is preferably about 90 degree. Moreover, the device comprises at least one closing force generating means for generating a predetermined closing force, which presses the oven door against the oven housing in the closed position of the oven door in order to achieve a desired sealing effect. Furthermore, kinematic means are provided, which are coupled to the hinge and to a moveable element in such a manner, that the predetermined pivoting opening and closing movement of the hinge is converted into a predetermined reciprocating opening and closing movement of the moveable element. The kinematic means are, e.g. of mechanical nature and may comprise a combination of gear and rack, connecting rods, etc. Moreover, the oven door opening and closing device according to the present invention contains at least one damping system. The damping system comprises a damper, e.g. a mechanic, pneumatic or hydraulic damper, for generating a damping force. This damping force counteracts the closing movement of the movable element within a predetermined section or range, which corresponds to a predetermined angle section of the pivoting closing movement of the hinge. Accordingly, the pivoting movement of the oven door is slowed down during its closing movement, preferably about the last 30 degree of the closing movement, in order to eliminate the impact noise.

Moreover, the kinematic means, the moveable element and the damping system can be arranged in such a manner that they are not visible from outside. Accordingly, the appearance of the oven is not deteriorated by theses components.

Advantageously, one or more hinge housings are provided, which are fixable to the oven housing. Each hinge housing can accommodate a hinge, a kinematic mechanism, a moveable element as well as a damping system. Accordingly, the installation and handling of the oven door opening and closing device according to the present invention is improved. Moreover, the movable element is preferably guided within the hinge housing in order to insure an accurate reciprocating movement.

According to one aspect of the present invention the damping system comprises a conversion mechanism, which preferably comprises a threaded spindle and a spindle nut. The conversion mechanism partially transforms the reciprocating movement of the moveable element into a rotational movement of a rotary element, whereby a rotary damper, which is preferably arranged at the threaded spindle or at the spindle nut, is used for damping said rotational movement of the rotary element. Accordingly, the speed of the closing movement within the predetermined angle section of the oven door can be adjusted by means of changing the incline of the threads of the spindle and the spindle nut and/or the damping force of the rotary damper. Moreover, it is possible to freely define, adjust and change the predetermined angle section.

Preferably, the rotary damper comprises an inner part and an outer part and a or the threaded spindle interacts with the inner part or the outer part of the rotary damper and/or the rotary damper comprises a or the spindle nut and/or a or the threaded spindle.

Preferably, the rotary damper comprises a) a free run function, so that the damping function is working into one direction only, especially implemented by a damper stop element and/or b) a threaded nut screwed onto a spindle to form a rotary damping element.

Preferably, the damping system comprises returning means for returning the component, which is to be damped by means of the damper, e.g. the threaded spindle, in a predetermined position after damping is completed.

Moreover, the present invention provides an oven comprising an oven door opening and closing device having the above-mentioned construction.

BRIEF DESCRIPTION OF THE ACCOMPANYING DRAWINGS

The detailed configuration, features and advantages of the present invention will become apparent in the course of the following description with reference to the accompanying drawings.

BEST MODES FOR CARRYING OUT THE INVENTION

Figure 1:
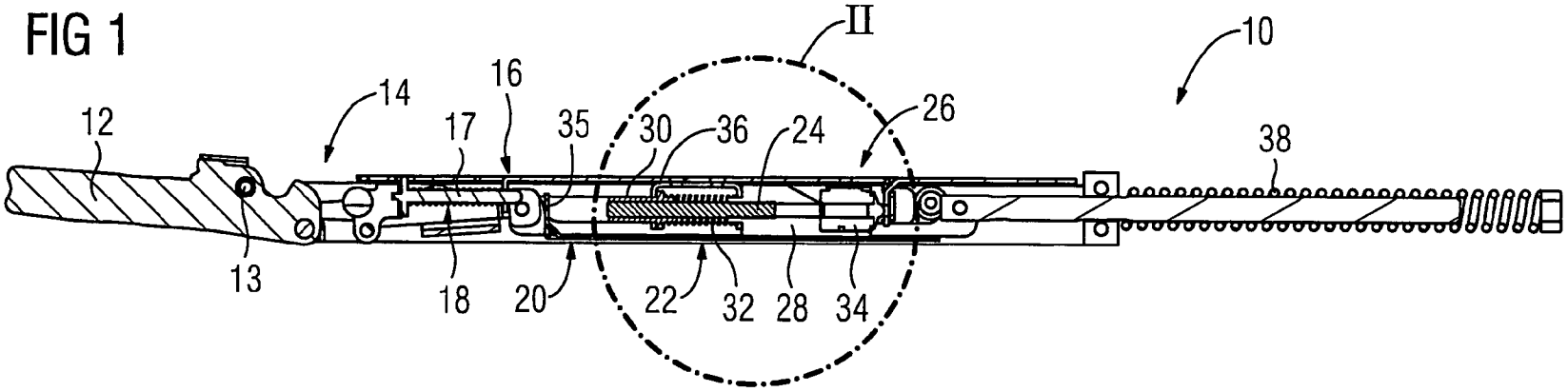
FIG. 1 is a schematic side view of a first embodiment of an oven door opening and closing device according to the present invention, whereby the oven door is arranged in its opened position.

Below, embodiments of the present invention will be described with reference to the figures. In these figures, like parts or portions are denoted by like reference numerals.

Figure 2:
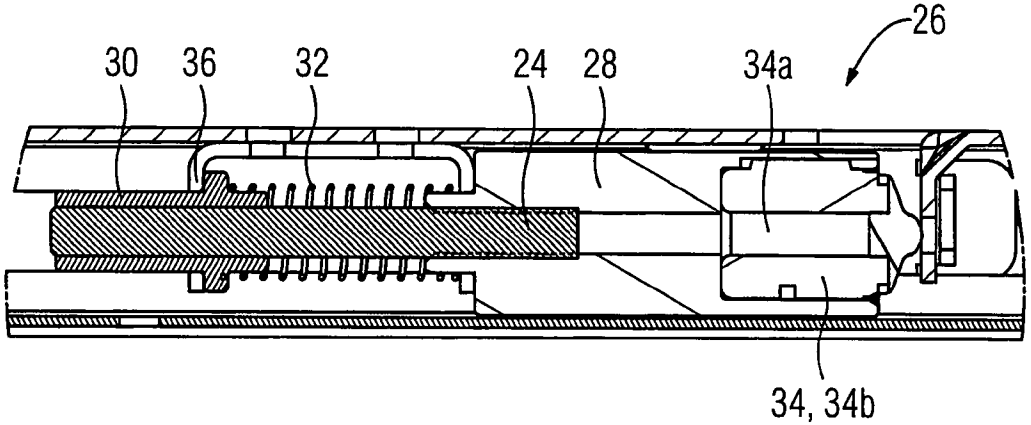
FIG. 2 is an enlarged view of the section II in FIG. 1.

FIG. 1 is a schematic side view of a first embodiment of an oven door opening and closing device 10 according to the present invention, and FIG. 2 is an enlarged view of the section II in FIG. 1. The oven door opening and closing device 10 serves for opening and closing an oven door 12 of an oven, which is not illustrated in the figures. In FIG. 1 the oven door 12 is arranged in its opened position.

As main components the oven door opening and closing device 10 comprises a hinge 14, a hinge housing 16, a closing force generating means 17, which forms a part of kinematic means 18, a movable element 20, a conversion mechanism 22, a rotary element 24 and a damping system 26.

Figure 5:
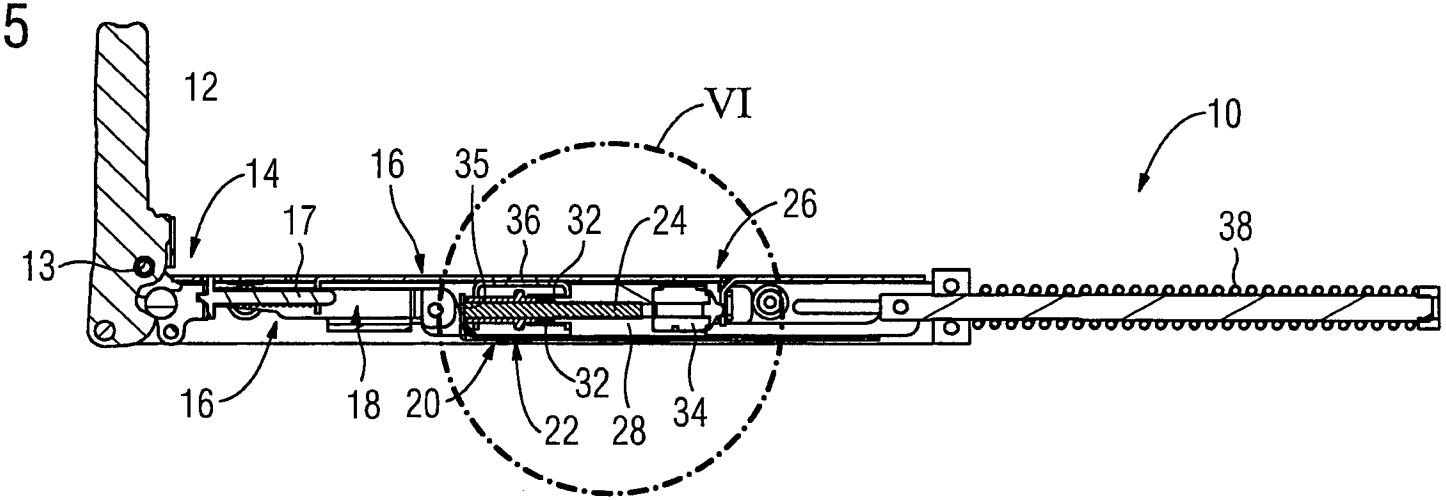
FIG. 5 is a schematic side view of the oven door opening and closing device according to the first embodiment, whereby the oven door is arranged in its closed position.

The hinge 14 is fixed to the oven door 12 and to the hinge housing 16 in such a manner that the oven door 12 can perform a predetermined pivoting opening and closing movement around the rotary axis 13 and relative to the oven housing between an open position shown in FIG. 1 and a closed position shown in FIG. 5, whereby the pivoting angle between these two positions is about 90 degree.

The hinge housing 16 is a long element, which is fixed to the oven housing. The hinge housing 16 may be produced by bending a long sheet-metal. However, it is also possible to use adequate profiles or the like.

The closing force generating means 17 is provided in form of a spring and biases the oven door 12 towards the oven housing, when the oven door 12 is arranged in its closed position.

The kinematic means 18 are inserted in the hinge housing 16 and coupled to the hinge 14 and to the moveable element 20 in such a manner, that the predetermined pivoting opening and closing movement of the hinge 14 is converted into a predetermined reciprocating opening and closing movement of the moveable element 20, which is guided within the hinge housing 16. The kinematic means 18 are not illustrated in detail in the figures. They are, e.g. of mechanical nature and may comprise a combination of gear and rack, connecting rods, etc., in order to convert the pivotal movement of the hinge 14 into a reciprocating linear movement. The conversion mechanism 22 is formed in such a manner that it partially transforms the reciprocating movement of the moveable element 20 into a rotational movement of a rotary element 24, which has the form of a threaded spindle. The conversion mechanism 22 comprises a spindle nut 28, in which one free end of the rotary element 24 is inserted, a slide bush 30, in which the other free end of the rotary element 24 is firmly held and which slidingly bears against the hinge housing 16, and a spring 32, which biases the slide bush 30 together with the rotary element 24 in the direction away from the spindle nut 28 (to the left in FIGS. 1 and 2).

The damping system 26 comprises a rotary damper 34, which is fixed to the end of the spindle nut 28 opposed to the rotary element 24 and serves for damping the rotational movement of the rotary element 24.

The rotary damper comprises an inner part 34*a* which extends along its axis circumferentially surrounded by an outer part 34*b*.

The threaded spindle 24 interacts with the inner part 34*a* of the rotary damper 34. However, as an alternative, the threaded spindle can also interact with the outer part of the rotary damper. Furthermore, also as an alternative, the rotary damper can comprise the spindle nut and/or the threaded spindle.

For closing the oven door 12—starting from its opened position shown in FIG. 1—the oven door 12 is rotated around the rotary axis 13 by a user. This pivoting movement of the oven door 12 or of the hinge 14 is converted by the help of the kinematic means 18 into a linear movement, which is transferred to the movable element 20, such that the movable element 20—starting from its position shown in FIG. 1—is moved to the right.

Figure 3:
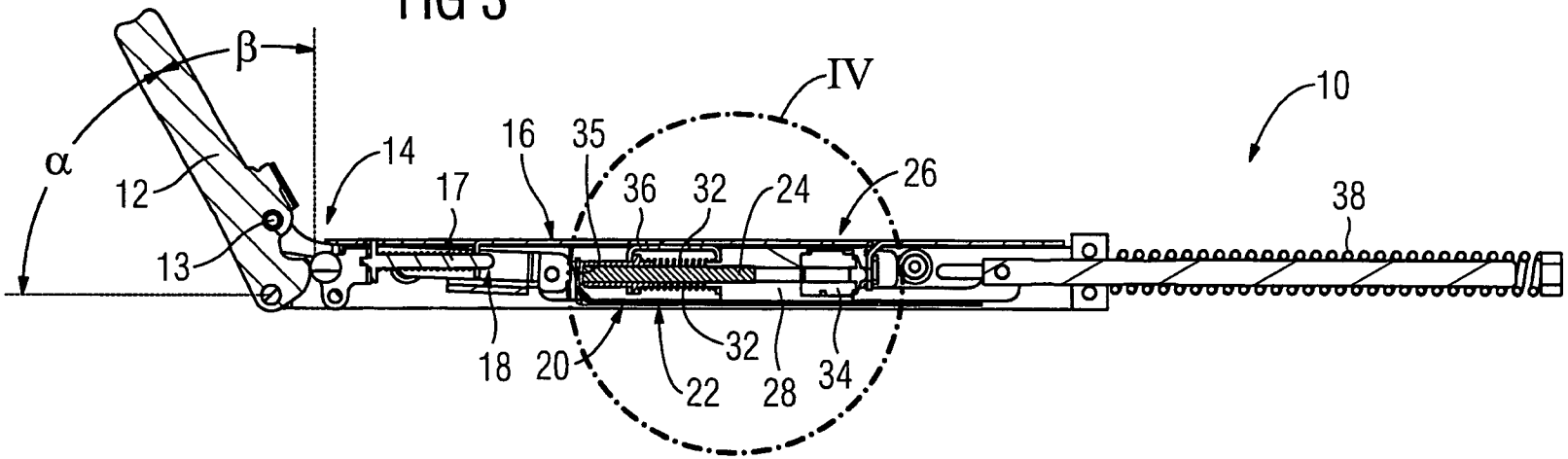
FIG. 3 is a schematic side view of the oven door opening and closing device according to the first embodiment, whereby the oven door is pivoted towards its closed position by a pivoting angle of 60 degrees.
Figure 4:
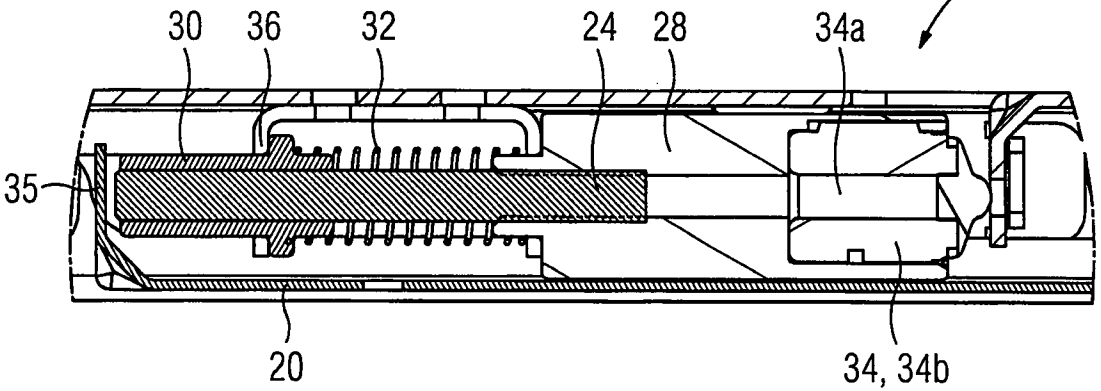
FIG. 4 is an enlarged view of the section IV in FIG. 3.

Between the opened position of the oven door 12 shown in FIG. 1 and a pivoting angle $\alpha$ of 60 degree, which is shown in FIG. 3, the movable element 20 can freely slide within the hinge housing 16. As soon as the pivoting angle $\alpha$ of 60 degree is reached, the upstanding portion 35 of the movable element 20 comes into contact with the rotary element 24, as it is best shown in FIG. 4, which is an enlarged view of the section IV in FIG. 3. Accordingly, the rotary element 24 is pushed to the right against the force of the spring 32 and rotated, when the oven door 12 is moved further towards its closed position. This rotary movement of the rotary element 24 is damped by means of the rotary damper 34 of the damping system 26, such that the pivoting movement of the oven door 12 is slowed down within the pivoting angle $\beta$ shown in FIG. 3, which is about 30 degree. In this manner, the impact noise can be eliminated, when the oven door 12 comes into contact with the oven housing in the closed position of the oven door 12 as shown in FIGS. 5 and 6.

Figure 6:
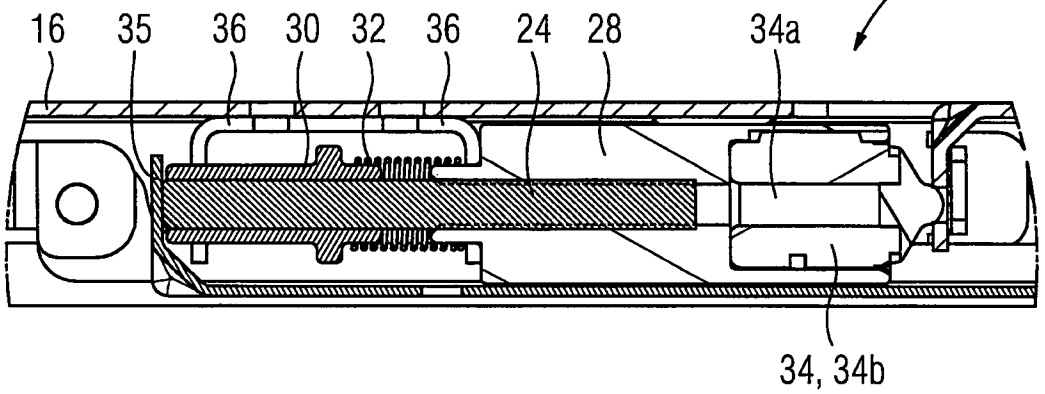
FIG. 6 is an enlarged view of the section VI in FIG. 5.

When the oven door 12 is opened again starting from the closed position illustrated in FIGS. 5 and 6, the movable element 20 is drawn to the left by the kinematic means 18. Moreover, the rotary element 24 is moved to the left by means of the spring 32, until the rotary element 24 reaches the position depicted in FIGS. 3 and 4 and comes into contact with the stopper 36, which is arranged within the hinge housing 16.

The speed or damping of the closing movement within the angle section β of the oven door 12 can be adjusted by means of changing the incline of the steep threads of the rotary element 24 and of the spindle nut 28 and/or the damping force of the rotary damper 34. Moreover, it is possible to freely define, adjust and change the angle section β.

The spring 38, which is arranged at the free end of the hinge housing 16, serves for compensating the weight of the oven door 12 while opening it. The arrangement of such springs is known in prior art technology. Therefore, the arrangement of the spring 38 is not described in detail herein.

Figure 7:
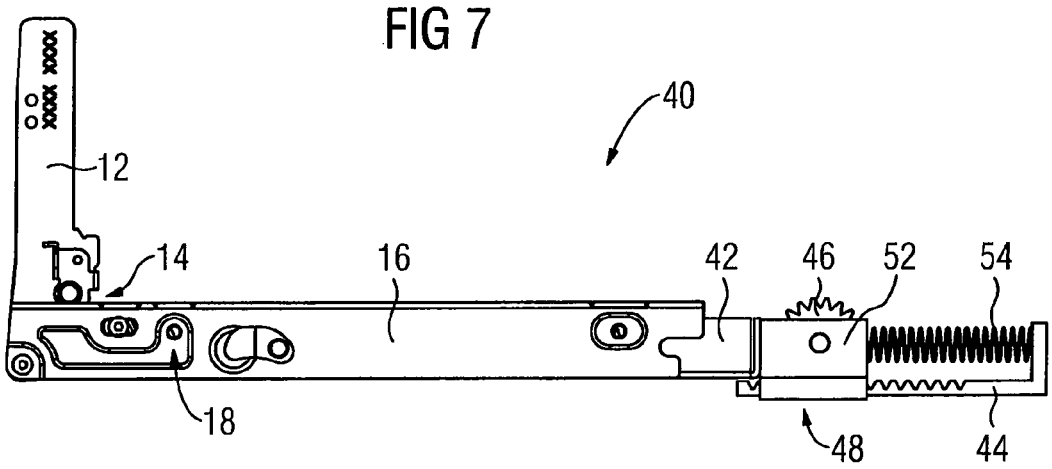
FIG. 7 is a schematic side view of a second embodiment of an oven door opening and closing device according to the present invention.

FIG. 7 is a schematic side view of a second embodiment of an oven door opening and closing device 40 according to the present invention for opening and closing an oven door 12. Similar to the arrangement shown in FIGS. 1 to 6, the oven door opening and closing device 40 comprises a hinge 14, a hinge housing 16, kinematic means 18, a movable element 42, a conversion mechanism 44, a rotary element 46 and a damping system 48 as main components. The construction of the hinge 14 and the kinematic means 18 essentially corresponds to the one shown in FIGS. 1 to 6. The movable element 42 is formed as a rod, which extends through the hinge housing 16 and is guided therein. Accordingly, the movable element 42 performs a reciprocating linear movement, when the oven door 12 is opened and closed. On the right side of the hinge housing 16 in FIG. 7 the conversion mechanism 44 is arranged, which is provided in form of a rack, which meshes with the rotary element 46, which has the form of a gear. The rotary element 46 is operatively connected to a rotary damper 52 of the damping system 48, which damps the rotary movement of the rotary element 46.

When the oven door 12 is transferred form its opened position to its closed position shown in FIG. 7, the pivoting movement of the oven door 12 is converted in a linear movement by the kinematic means 18 and transferred to the movable element 42, which is then pushed to the right against the rotary damper 52, which is slidingly positioned on the rack. Accordingly, the rotary damper 52 is also pushed to the right, so that the rotary element 46 meshes with the rack and rotates. The rotary movement of the rotary element 46 is damped by means of the rotary damper 52. As a consequence, also the closing movement of the door is damped. By varying the position and the damping force of the rotary damper 52 and/or the tooth pitch of the rack and the rotary element 46, the damping of the closing movement as well as the predetermined closing angle range (see angle β in FIG. 3) can be adjusted, in which the damping takes place.

When the oven door 12 is opened again, a restoring spring 54 pushes the rotary damper 52 back to its initial position.

Figure 8:
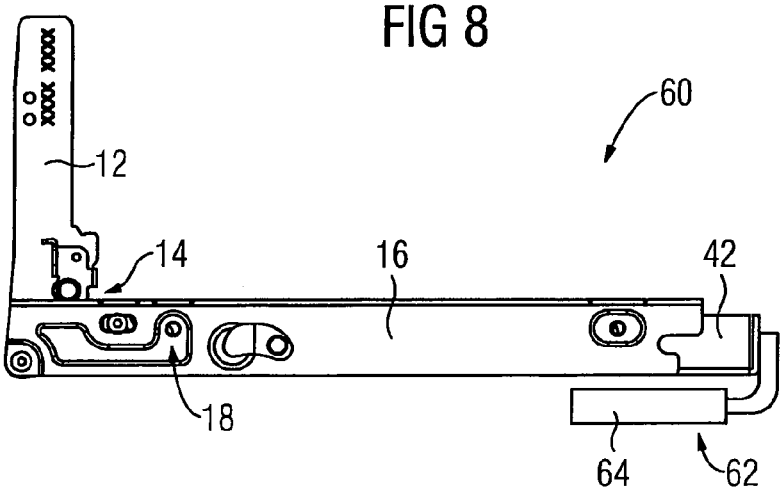
FIG. 8 is a schematic side view of a third embodiment of an oven door opening and closing device according to the present invention.

FIG. 8 is a schematic side view of a third embodiment of an oven door opening and closing device 60 according to the present invention for opening and closing an oven door 12. The oven door opening and closing device 60 essentially corresponds to the device 40 shown in FIG. 7. It comprises a hinge 14, a hinge housing 16, kinematic means 18, a movable element 42 and a damping system 62 as main components. The construction of the hinge 14, the kinematic means 18 and the movable element 42 essentially corresponds to the one shown in FIG. 7. Accordingly, the movable element 42 performs a reciprocating linear movement, when the oven door 12 is opened and closed. An air damper 64 of the damping system 62 is operatively connected to the movable element 42, which at least partially damps the linear closing movement of the movable element 42. Accordingly, the closing movement of the oven door 12 is also damped. As soon as the oven door 12 is opened again, the air damper 64 returns to its initial position.

Figure 9:
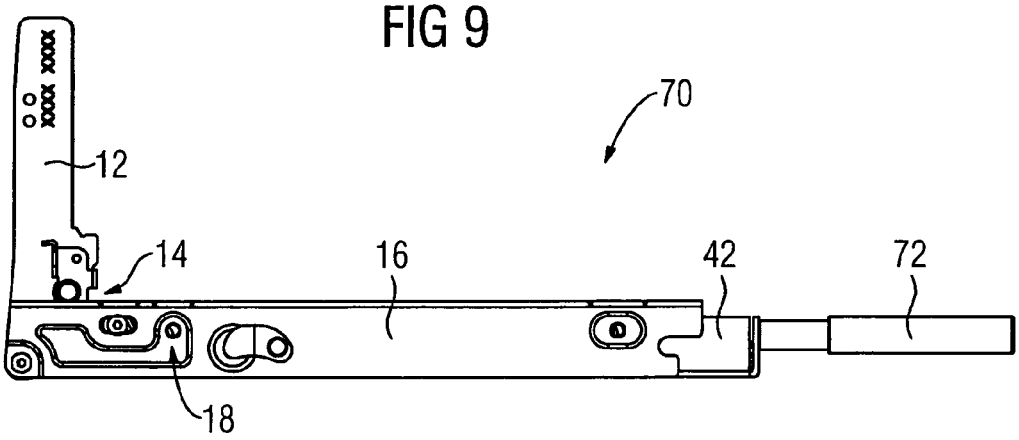
FIG. 9 is a schematic side view of a forth embodiment of an oven door opening and closing device according to the present invention.

FIG. 9 is a schematic side view of a forth embodiment of an oven door opening and closing device 70 according to the present invention. This oven door opening and closing device 70 essentially corresponds to the oven door opening and closing device 60 shown in FIG. 8. However, the air damper 64 of the oven door opening and closing device 60 is replaced by a hydraulic damper 72, which is positioned outside the hinge housing 16. However, the principal functioning is the same.

Figure 10:
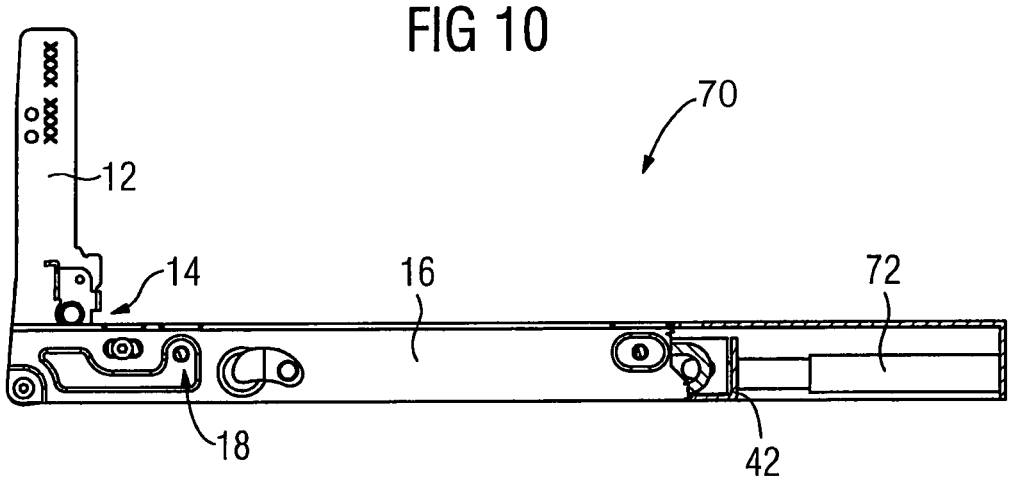
FIG. 10 is a schematic side view of a variant of forth embodiment of an oven door opening and closing device according to the present invention shown in FIG. 9.

FIG. 10 is a schematic side view of a variant of forth embodiment of the oven door opening and closing device 70 shown in FIG. 9. In this variant, the hydraulic damper 72 is integrated in the hinge housing 16.

Figure 11:
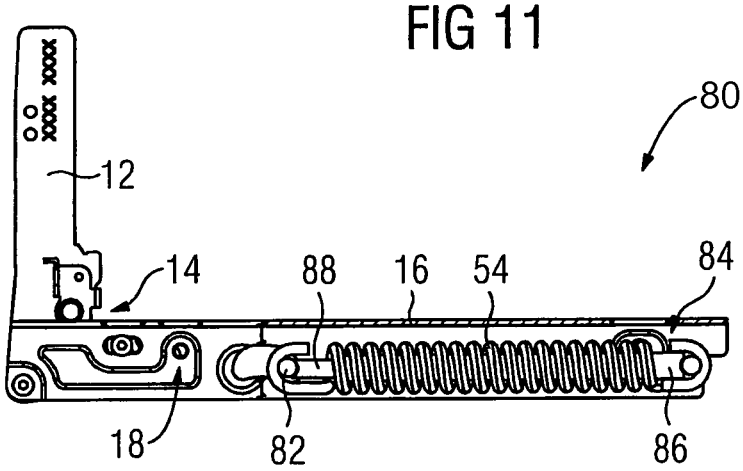
FIG. 11 is a schematic side view of a fifth embodiment of an oven door opening and closing device according to the present invention.

FIG. 11 is a schematic side view of a fifth embodiment of an oven door opening and closing device 80 according to the present invention for opening and closing an oven door 12. The oven door opening and closing device 80 comprises a hinge 14, a hinge housing 16, kinematic means 18, a movable element 82, a damping system 84 and a restoring spring 54 as main components. The constructions of the hinge 14 and the kinematic means 18 essentially correspond to the ones of the foregoing embodiments. The movable element 82 is formed as a movable bolt. Accordingly, the movable element 82 performs a reciprocating linear movement, when the oven door 12 is opened and closed. One free end of the restoring spring 54 is fixed to the movable element 82. The other free end of the restoring spring 54 is held by a bolt 86, which is fixedly positioned within the hinge housing 16. Accordingly, the restoring spring 54 is lengthened, when the oven door 12 is opened, in order to compensate the weight of the oven door 12. Moreover, a hydraulic or pneumatic damper 88 is fixed to the movable element 82 and the bolt 86 and extends inside the restoring spring 54. Accordingly, the movement of the movable element to the right and thus the closing movement of the oven door 12 are damped by means of the damper 88.

FIGS. 12 to 15 show schematic cross sectional views of a sixth embodiment of an oven door opening and closing device 90 according to the present invention for opening and closing an oven door 12.

Figure 12:
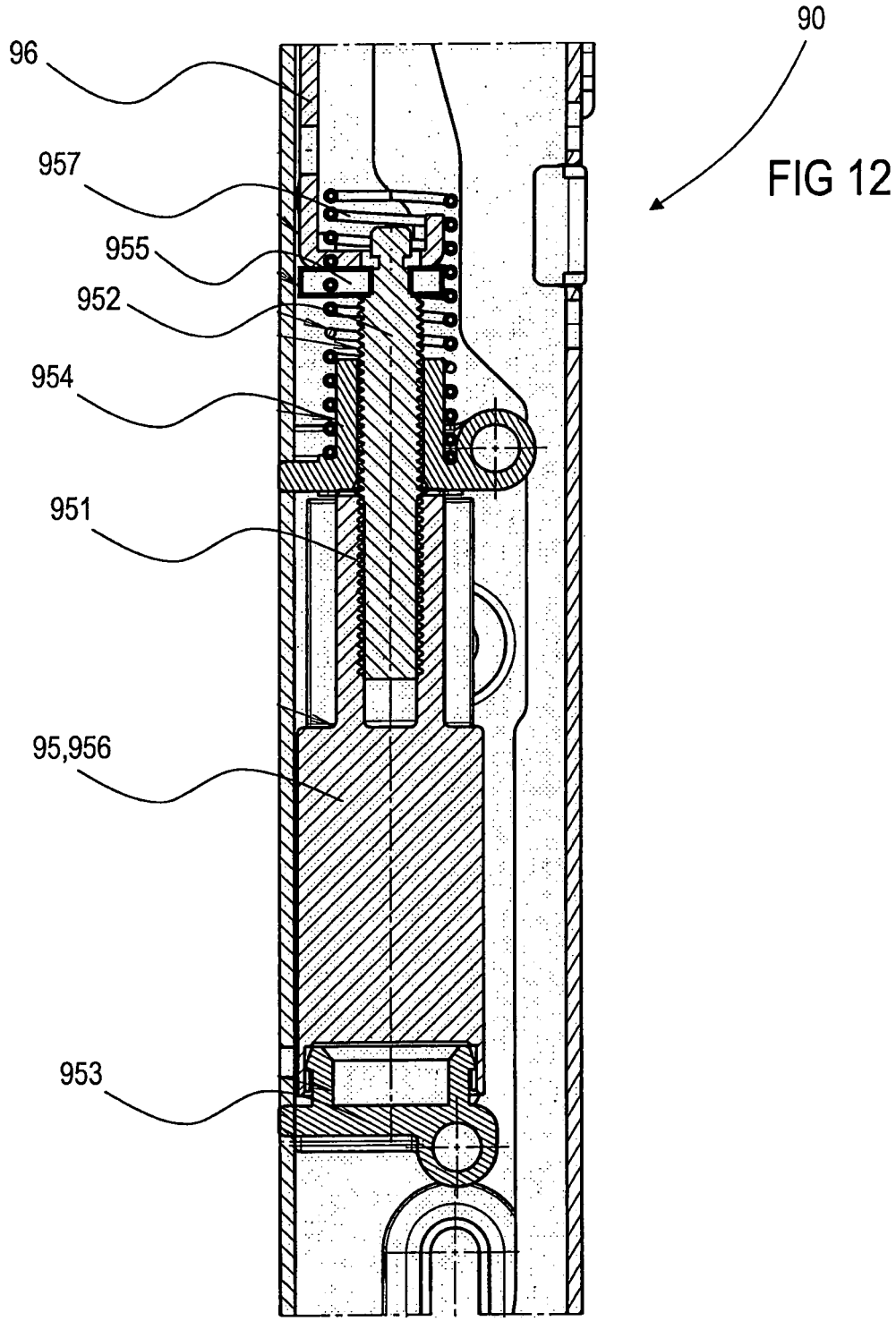
FIG. 12 is a schematic cross sectional view of the central area of a sixth embodiment of an oven door opening and closing device according to the present invention.
Figure 13:
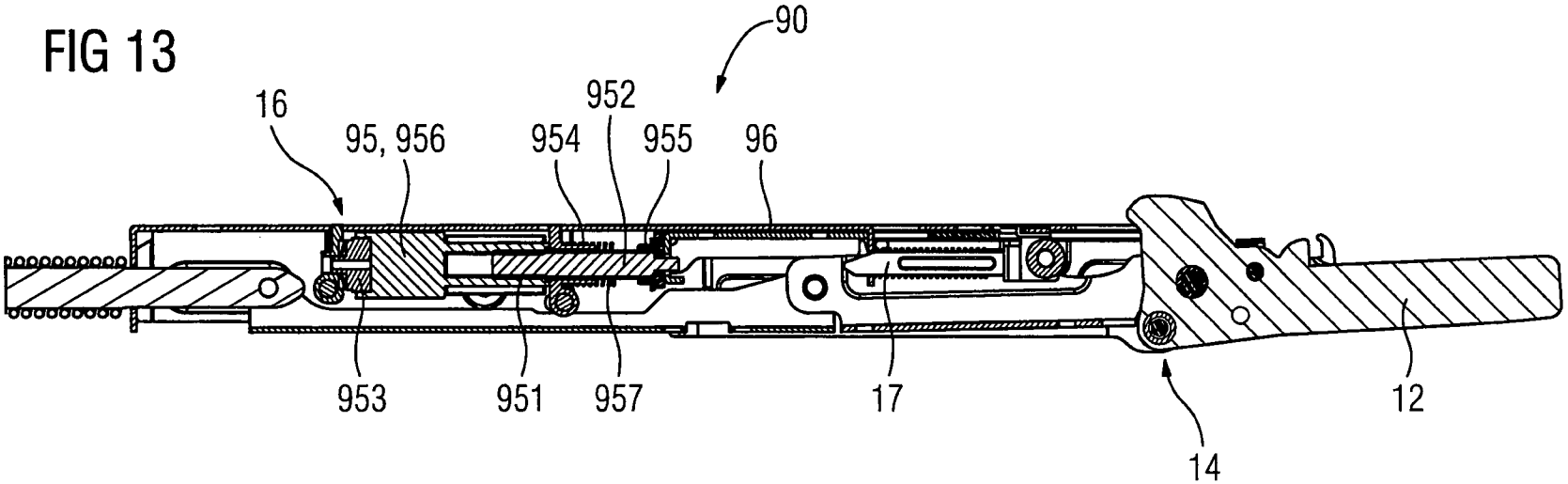
FIG. 13 is a schematic side view of the sixth embodiment of the oven door opening and closing device in FIG. 12 according to the present invention, whereby the oven door is arranged in its opened position.
Figure 14:
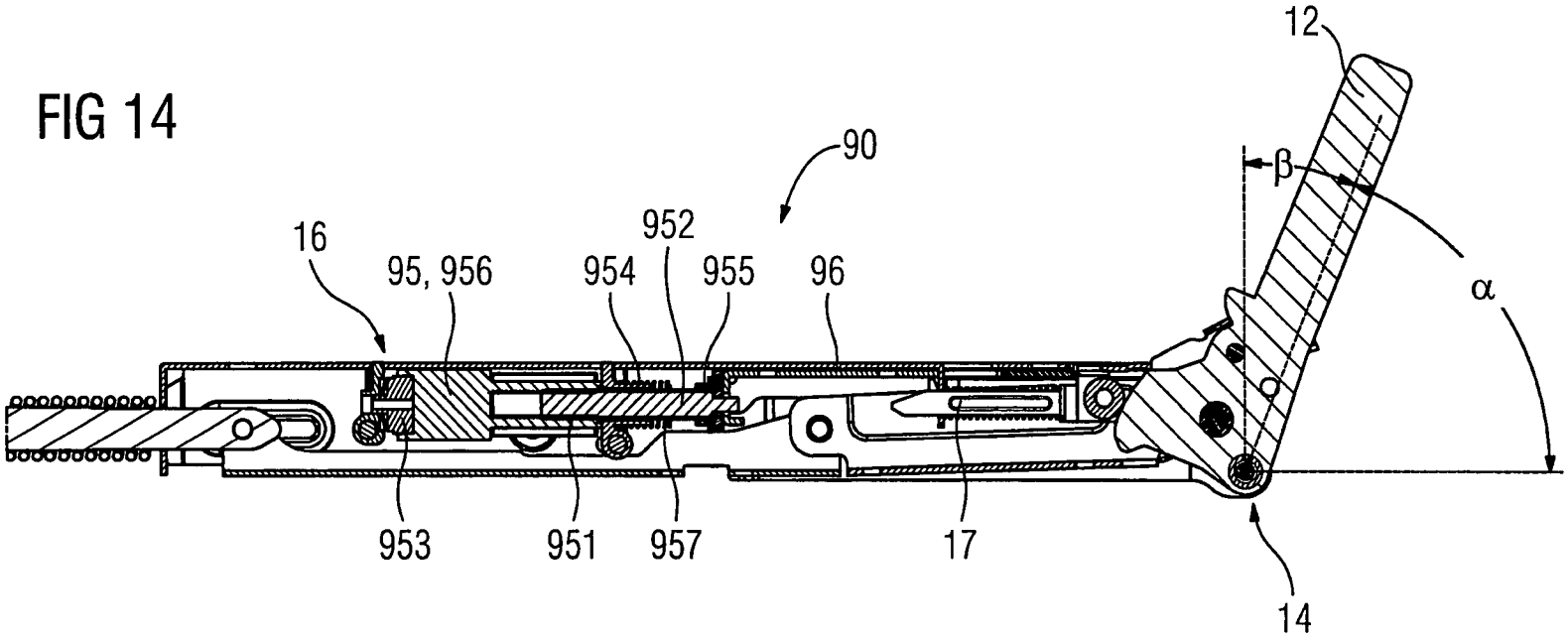
FIG. 14 is a schematic side view of the oven door opening and closing device according to the sixth embodiment, whereby the oven door is pivoted towards its closed position by a pivoting angle of 60 degrees
Figure 15:
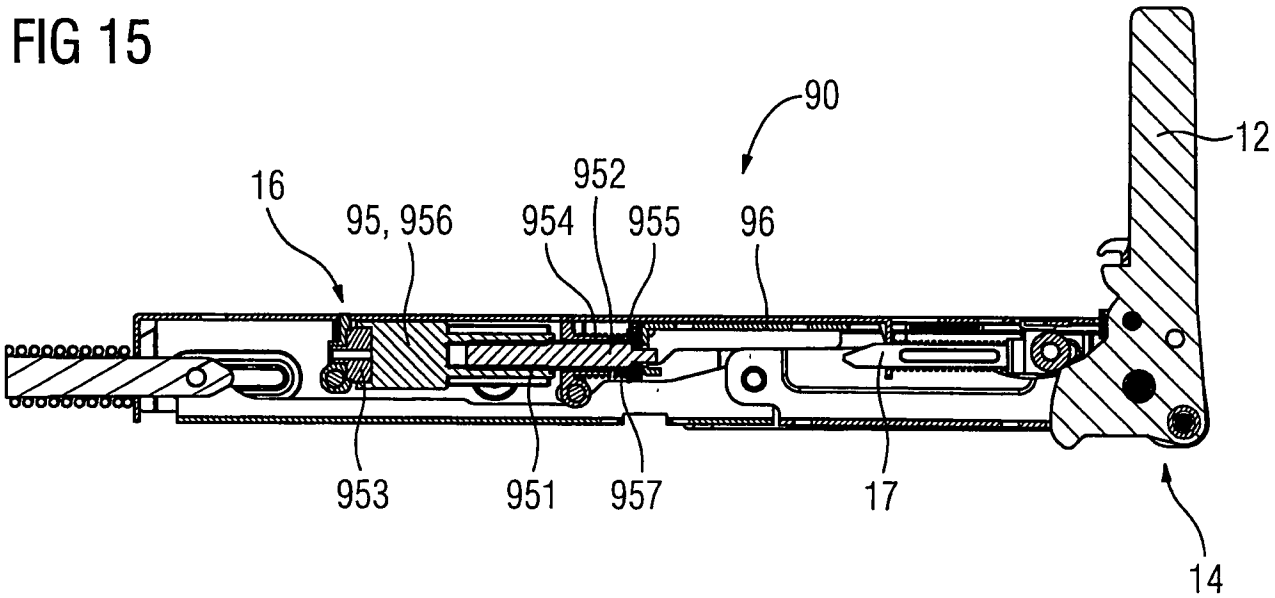
FIG. 15 is a schematic side view of the oven door opening and closing device according to the sixth embodiment, whereby the oven door is arranged in its closed position.

FIG. 12 shows a schematic cross sectional view of the central area of the sixth embodiment of an oven door opening and closing device according to the present invention. FIG. 13 is a schematic side view of the sixth embodiment of an oven door opening and closing device in FIG. 12 according to the present invention, whereby the oven door is arranged in its opened position. FIG. 14 is a schematic side view of the oven door opening and closing device according to the sixth embodiment, whereby the oven door is pivoted towards its closed position by a pivoting angle of 60 degrees. FIG. 15 is a schematic side view of the oven door opening and closing device according to the sixth embodiment, whereby the oven door is arranged in its closed position.

The oven door opening and closing device 90 comprises a rotary damper 95 with a spindle 952 as a rotary element and furthermore comprises a threaded nut 951, a cylindrical body 956, a damper stop element 953, a guiding means 954 as well as a ring shaped element 955 and a spring 957.

The guiding means 954 is also substantially ring-shaped and embraces the spindle 952 along its central part, is fixed to the hinge housing 16 and serves as one fixing element for the spring 957. The door sided end of the spring 957 is fixed to the spindle 952.

The threaded nut 951 embraces the spindle around its part directed away from the door and is attached to the door sided end of the cylindrical body 956, wherein the threaded nut 951 and the cylindrical body 956 form a single piece. At the other end of the cylindrical body 956, the damper stop element 953 is rotatably fixed.

Again, between the opened position of the oven door 12 shown in FIG. 13 and a pivoting angle α of 60 degree, which is shown in FIG. 14, the movable element 96 can freely slide within the hinge housing. As soon as the pivoting angle α of 60 degree is reached, the upstanding portion of the movable element 96 comes into interacting connection with the spindle 952 as rotary element, as shown in FIG. 12.

As a contact element between the upstanding portion of the movable element 96 and the spindle 952, the ring shaped element 955 is arranged around the spindle 952 near the door-sided end of the spindle. The moveable element 96 is pushed against the ring shaped element 955 and against the force of the spring 957 and the spindle is rotated, when the oven door 12 is moved further towards its closed position.

The rotary movement of the spindle 952 is damped by means of the threaded nut 951 which is embracing, as an interacting connection, the spindle 952 in such a way that the pivoting movement of the oven door 12 is slowed down within the pivoting angle β shown in FIG. 14, which is about 30 degree.

Also in this manner, the impact noise can be eliminated, when the oven door 12 comes into contact with the oven housing in the closed position of the oven door 12 as shown in FIG. 15.

Furthermore, the damper stop element 953 implements a free run function, which means that the damping function is working in one direction only.

It should be noted, that all of the above-described embodiments provide oven door opening and closing devices, which are not visible, when the oven is regarded from outside. Accordingly, the appearance of the oven is not adversely effected by such oven door opening and closing devices. Moreover, all of the above-mentioned oven door opening and closing devices are adjustable with respect to the damping force for slowing down the closing movement of the oven door. Furthermore, the above-described first, second, third and fourth embodiments of oven door opening and closing devices according to the present invention are also adjustable with respect to the pivoting angle range (angle β in FIG. 3), in which a damping of the closing movement of the oven door takes place.

Although exemplary embodiments of the present invention have been described in detail above, those skilled in the art will readily appreciate that many modifications are possible with respect to the exemplary embodiments, without materially departing from the novel teachings and advantages of this invention. Accordingly, all such modifications are intended to be included within the scope of the present invention, which is defined by the claims.

The invention claimed is:

1. An oven, comprising:

an oven housing;

an oven door pivotally coupled to the oven housing; and an oven door opening and closing device fixed at a stationary position to the oven housing and comprising at least one hinge, which is connectable between the oven door and the oven housing for realizing a pivoting opening and closing movement of the oven door relative to the oven housing between an open and a closed position;

at least one closing spring that generates a closing force to bias the oven door towards the oven housing;

a kinematic member that is coupled to the hinge and to a moveable element in such a manner, that the pivoting opening and closing movement of the hinge is converted into a reciprocating opening and closing linear movement of the moveable element; and at least one damping system having a damper for generating a damping force which counteracts the closing movement of the movable element within a section, which corresponds to an angle section (β) of the pivoting closing movement of the hinge shortly prior to the closed position, wherein the angle section (β) of the pivoting closing movement of the hinge reaches from an opening angle of about 30 degrees to about 0 degrees, of which the latter corresponds to the closed position of the hinge, wherein the damping system comprises a conversion mechanism, separate from the hinge, that causes the linear movement of the moveable element along a first direction to be transformed into a rotational movement of a rotary element about a rotational axis oriented along said first direction, and wherein the rotary element comprises a threaded spindle and the conversion mechanism comprises a spindle nut threaded onto said spindle;

wherein the damper is a rotary damper for damping said rotational movement of the threaded spindle of the rotary element, said rotary damper being constrained to rotational motion only with respect to the rotary element;

wherein the rotary damper is coupled to the spindle nut;

wherein linear movement of the movable element applied to the threaded spindle causes relative rotation between the threaded spindle and the spindle nut that drives only rotational motion of the rotary damper to thereby generate a damping force that counteracts the closing force of said closing spring; and wherein the damping system further comprises a returning spring immediately coupled to the threaded spindle to resiliently bias the threaded spindle away from the spindle nut and thereby return the damping system towards an initial position.

2. The oven according to claim 1, wherein an angle between the open and the closed position is about 90 degrees.

3. The oven according to claim 1 , wherein at least one hinge housing is provided, which is fixable to the oven housing.

4. The oven according to claim 3, wherein the movable element is guided within the hinge housing.

5. The oven according to claim 1, wherein the rotary damper comprises an inner part and an outer part and the threaded spindle interacts with the inner part or the outer part of the rotary damper.

6. The oven according to claim 1, wherein the rotary damper comprises at least one of a free run function, so that the damping function is working into one direction only, implemented by a damper stop element, and a threaded nut screwed onto a spindle to form a rotary damping element.

7. The oven according to claim 1, further comprising a slide bushing secured to an end of the threaded spindle and in direct engagement with the returning spring, wherein the returning spring is immediately coupled to the threaded spindle via the slide bushing.

* * * * *